US005469972A

United States Patent [19]

St-Pierre et al.

[11] Patent Number: 5,469,972

[45] Date of Patent: Nov. 28, 1995

[54] SCREENING APPARATUS AND METHOD FOR SCREENING MIXED MATERIALS

[75] Inventors: Jean-Guy St-Pierre; André Godbout, both of Plessisville, Canada

[73] Assignee: les Équipements Vibrotech Inc., Plessisville, Canada

[21] Appl. No.: 276,108

[22] Filed: Jul. 15, 1994

[30] Foreign Application Priority Data

Aug. 31, 1993 [CA] Canada ..... 2105232

[51] Int. Cl.[6] ..... B07B 1/46; B07B 13/16

[52] U.S. Cl. ..... 209/245; 209/254; 209/421; 209/910; 198/747

[58] Field of Search ..... 209/240, 243, 209/244, 245, 246, 247, 254, 315, 420, 421, 910; 198/738, 747

[56] References Cited

U.S. PATENT DOCUMENTS

| | | | |
|---|---|---|---|
| 1,791,345 | 2/1931 | Bishop | 209/245 |
| 2,384,181 | 9/1945 | La Fave | 209/245 X |
| 4,190,526 | 2/1980 | Bachand | 209/245 |
| 4,197,194 | 4/1980 | Read | 209/325 |
| 4,256,572 | 3/1981 | Read | 209/257 |
| 4,303,506 | 12/1981 | Finlay | 209/421 X |
| 4,983,280 | 1/1991 | Eriksson | 209/420 X |
| 5,082,555 | 1/1992 | Read | 209/244 |
| 5,106,490 | 4/1992 | McDonald | 209/240 |
| 5,232,098 | 8/1993 | St-Pierre et al. | 209/240 |

FOREIGN PATENT DOCUMENTS

| | | | |
|---|---|---|---|
| 609392 | 2/1935 | Germany | 209/245 |

*Primary Examiner*—William E. Terrell
*Assistant Examiner*—Tuan Nguyen
*Attorney, Agent, or Firm*—Darby & Darby

[57] ABSTRACT

A screening apparatus and a method are provided for separating mixed material into coarse materials and finer materials. After dumping mixed materials with a loader into a bucket located in an upper section of a screening apparatus, a movable wall moving at a predetermined speed along the bottom of the bucket pushes the mixed materials into a bottom opening of the bucket over a first material separating screen defining a slope with reference to the ground and subjected to vibrations of a shaking device. The apparatus may further comprise parallel spaced bars for primary removing of large debris.

12 Claims, 4 Drawing Sheets

SCREENING APPARATUS AND METHOD FOR SCREENING MIXED MATERIALS

FIELD OF THE INVENTION

The present invention relates to a screening apparatus for separating mixed material into coarse materials and finer materials, and a method for screening mixed materials.

BACKGROUND OF THE INVENTION

Known in the art, there are screening apparatuses used for separating mixed materials, such as loam, sand, gravel or other similar products, into coarse and finer materials with the use of a vibrating meshed screen. The meshes of the screening are sized according to the desired size of the finer materials. Generally, the mixed materials are sieved two or three times for obtaining a suitable quality and are conveyed through the apparatus with belt conveyors or archimedes screws.

For obtaining greater efficiency and for other numerous reasons, such as the greater transportation costs and the local legislations on storage, more and more excavation firms process the top soil and other types of soil on site. Generally, the process consists in directly putting the mixed materials from the ground into the apparatus. This is particularly suitable when the separated materials are used on the site. The same process may also be used in a sand quarry.

Generally, the separating apparatus currently used are bulky and are difficult to be moved. Most of them have problems with large rocks, stumps or wood pieces which affect the separating and may damage the apparatus.

The screening apparatus used in the prior art are generally loaded with a loader dropping the mixed materials into the apparatus. This may lower the efficiency of the apparatus because the screen will be saturated and not able to get all the fine materials which will be rejected by the coarse materials. Some apparatuses have been provided to resolve the above-mentioned drawback, like U.S. Pat. No. 5,082,555 issued on Jan. 21, 1992, which uses a tilting hopper body. Such arrangement is however difficult to use with humid materials which tend to stick together and fall in sequence when the tilt angle is important.

SUMMARY OF THE INVENTION

The object of the present invention is to provide a screening apparatus which allows a constant feeding of the vibrating screen of a screening apparatus to produce an efficient screening even when the material is humid.

More particularly, the object of the present invention is to provide a screening apparatus for separating mixed material into coarse materials and finer materials, the screening apparatus comprising:

- a frame having a lower section for resting on a surface, and an upper section;

- a vibrating screen unit comprising a first material separating screen sloping downward with respect to the surface from an upper edge toward a lower edge, the first material separating screen being supported by the frame between the lower and upper sections;

- shaking means for shaking the vibrating screen unit;

- a bucket for receiving the mixed materials, the bucket being located in the upper section of the frame and comprising a bottom opening located over the first material separating screen adjacent the upper edge thereof;

- a wall movable along the bottom of the bucket for pushing the mixed materials into the bottom opening; and

- means for moving the wall at a predetermined speed.

In use, the first material separating screen is fed with the mixed materials as the wall pushes the mixed materials at the predetermined speed along the bottom of the bucket into the bottom opening.

According to a preferred embodiment, the bucket has a superior part provided with screen means for preventing large coarse materials from falling into the bucket. Preferably, the screen means comprise a plurality of spaced bars parallel to each other and parallel to the displacement of the wall, the bars having ends inserted in slots provided in the upper section of the frame.

According to another preferred embodiment, the screening apparatus may further comprises means for sweeping away the large coarse materials on an upper surface of the screen means. The means for sweeping away the large coarse materials preferably comprise a movable rack operated by a cable and pulley linkage provided for moving the rack along the upper surface of the screen means in a direction opposite to a direction of movement of the wall.

According to a still preferred embodiment, the means for moving the wall comprise at least two hydraulic actuators, each of the actuators operating an arm having a first end operatively attached to the frame and a second end operatively attached to the wall.

According to a still preferred embodiment, the vibrating screen unit comprise a second material separating screen underneath the first material separating screen and in parallel thereto, the second material separating screen having meshes smaller than meshes of the first material separating screen, whereby the finer materials are sieved a second time by the second material separating screen for obtaining further finer materials.

According to a still preferred embodiment, the screening apparatus further comprises a transversal longitudinal conveyor adjacent the lower edge of the first material separating screen for conveying the coarse materials rejected therefrom to a remote location.

According to a still preferred embodiment, the screening apparatus further comprises at least one pair of wheels and a trailer hitch so that the screening apparatus is portable.

The object of the present invention is also to provide a screening apparatus for separating mixed material into coarse materials and finer materials, the screening apparatus comprising:

- a frame having a lower section for resting on a surface, and an upper section;

- a vibrating screen unit comprising a first material separating screen sloping downward with respect to the surface from an upper edge toward a lower edge, and a second material separating screen underneath the first material separating screen and in parallel thereto, the second material separating screen having meshes smaller than meshes of the first material separating screen so that the finer materials are sieved a second time by the second material separating screen for obtaining further finer materials, the first and second material separating screens being supported by the frame between the lower and upper sections;

- shaking means for shaking the vibrating screen unit;

- a bucket for receiving the mixed materials, the bucket being located in the upper section of the frame and comprising a bottom opening located over the first material separating screen adjacent the upper edge thereof, and having a superior part provided with screen means for preventing large coarse materials from falling into the bucket, the screen means comprising a plurality of spaced bars parallel to each other and parallel to the displacement of the wall, the bars having ends inserted in slots provided in the upper section of the frame;

- means for sweeping away the large coarse materials of an upper surface of the screen means, the means for sweeping away the large coarse materials comprising a movable rack operated by a cable and pulley linkage provided for moving the rack along the upper surface of the screen means in a direction opposite to a direction of movement of the wall;

- a wall movable along the bottom of the bucket for pushing the mixed materials into the bottom opening;

- means for moving the wall at a predetermined speed, the means comprising at least two hydraulic actuators, each of the actuators operating an arm having a first end operatively attached to the frame and a second end operatively attached to the wall;

- a transversal longitudinal conveyor adjacent the lower edge of the first material separating screen for conveying the coarse materials rejected therefrom to a remote location; and

- at least one pair of wheels and a trailer hitch so that the screening apparatus is portable.

In use, the first material separating screen is fed with the mixed materials as the wall pushes the mixed materials at the predetermined speed along the bottom of the bucket into the bottom opening.

According to another object of the invention, there is provided a method for separating mixed material into coarse materials and finer materials, the method comprising the steps of:

- dumping mixed materials into a bucket located in an upper section of a screening apparatus;

- moving a wall at a predetermined speed along the bottom of the bucket for pushing the mixed materials into a bottom opening located in the bucket over a first material separating screen;

- shaking the first material separating screen. In the method, the first material separating screen is fed with the mixed materials as the wall pushes the mixed materials at the predetermined speed along the bottom of the bucket into the bottom opening.

The present invention thus allows a constant feeding of the vibrating screen in mixed materials.

A non restrictive description of a preferred embodiment will now be given with reference to the appended drawings.

DESCRIPTION OF A PREFERRED EMBODIMENT

Figure 1:
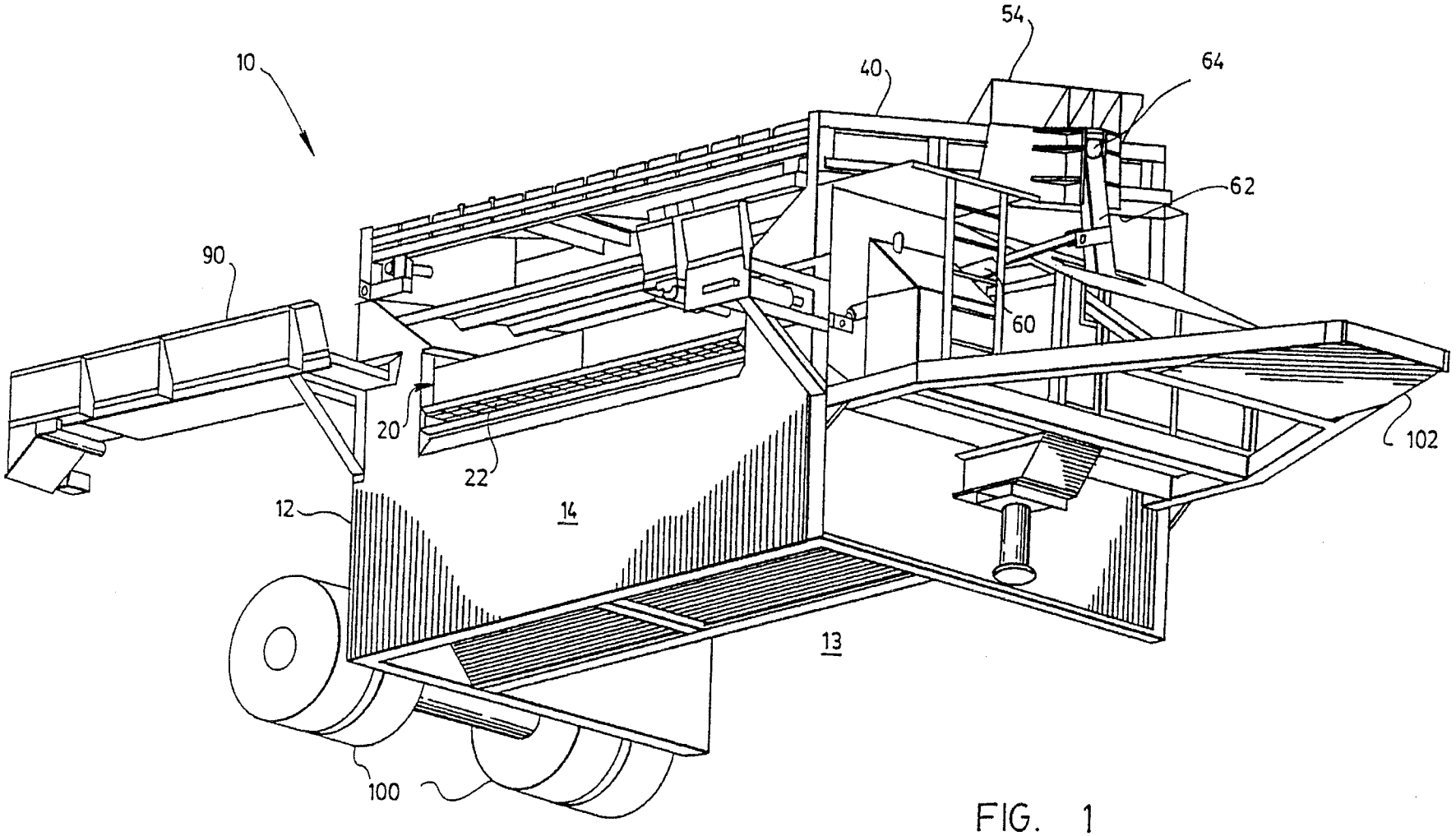
FIG. 1 is a bottom perspective view of the screening apparatus according to the invention, with the longitudinal conveyor shown partially.
Figure 2:
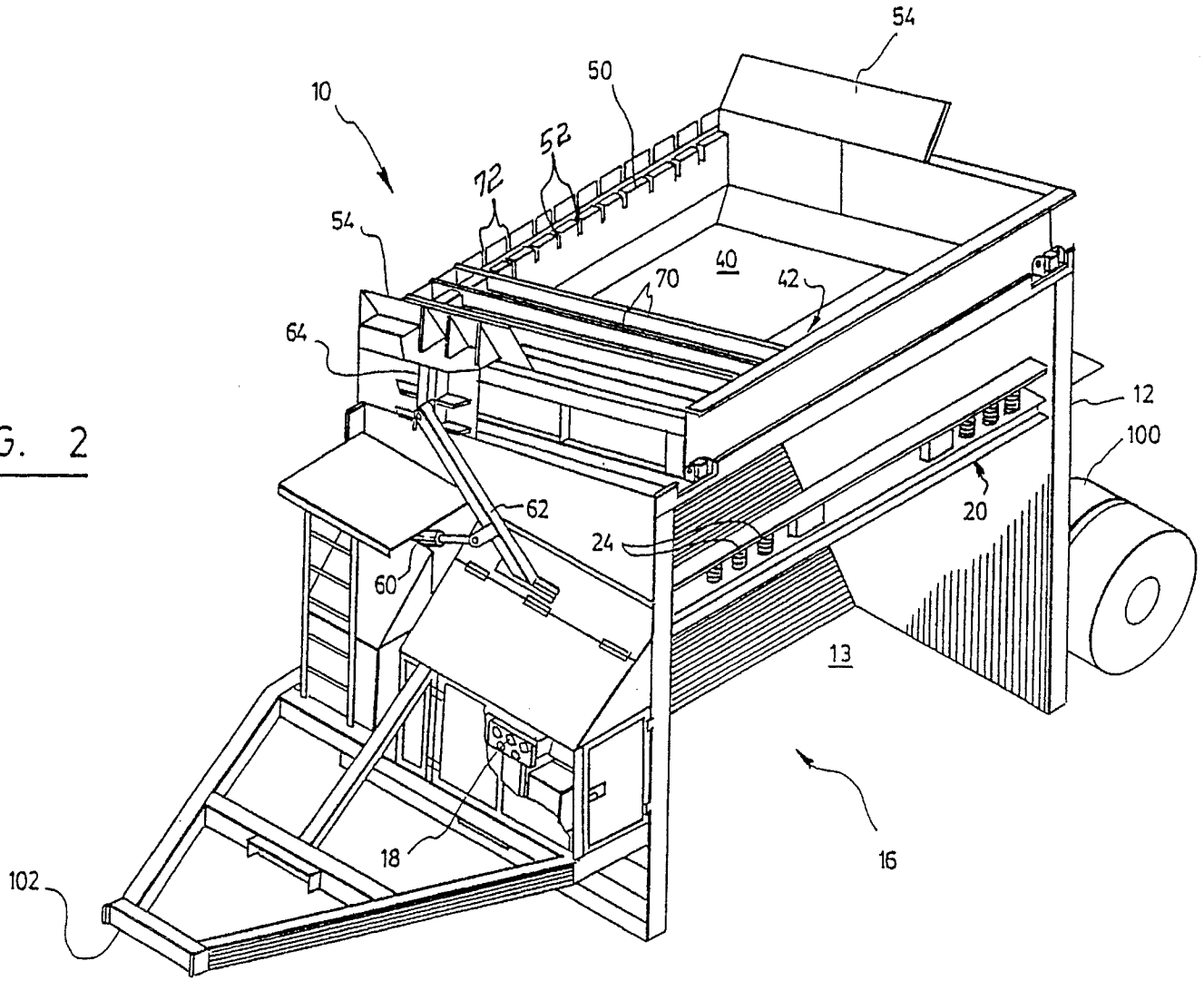
FIG. 2 is a top perspective view of the screening apparatus of FIG. 1.

Referring to FIGS. 1 and 2, there is shown a screening apparatus 10 for separating mixed material into coarse materials and finer materials, according to the invention. The apparatus 10 comprises a substantially rectangular frame 12 having a lower section for resting on a surface such as the ground, and an upper section. The frame 12 has closed and open sides 14 and 16. More specifically, the lower portion of the side 16 is opened to accommodate the bucket of a loader (not shown).

Within the frame 12 is located a vibrating screen unit 20 comprising a first material separating screen 22 sloping downward with respect to the surface from an upper edge toward a lower edge, so that something which does not pass through the screen 22 falls beside the closed side 14. The screen 22 is supported by the frame 12 between the lower and upper sections thereof. The mesh of the screen 22 is a selected with respect to the desired size of the fine material.

As shown in FIG. 2, the vibrating screen unit 20 comprises suspension springs 24 located at the sides of the frame 12.

The vibrating screen unit 20 is submitted to the vibrations of shaking means which may comprise a rotating eccentric shaft 26 unbalanced by weights and driven by an hydraulic motor (not shown), or by any other suitable mechanisms commonly used in the art and apparent to those skilled in the art. The power needed to activate the powered elements of the apparatus 10 may come from an engine 18 located on the frame 12.

The apparatus 10 comprises, at the top part thereof, a bucket 40 for receiving the mixed materials. The bucket 40 comprises a bottom opening 42 located over the screen 22 adjacent the upper edge thereof, next to the side 16.

As shown in FIG. 2, the apparatus 10 comprises a wall 50 movable along the bottom of the bucket 40 for pushing the mixed materials into the bottom opening, so that when a loader fills the bucket 40 with mixed materials to be treated by the apparatus 10, there is a progressive feeding of the screen 22. The screen 22 is thus fed with the mixed materials as the wall 50 pushes the mixed materials at the predetermined speed along the bottom of the bucket 40 into the bottom opening 42.

The means for moving the wall 50 at a predetermined speed preferably comprise two hydraulic actuators 60, each of the actuators 60 operating an arm 62 having a first end operatively attached to the frame 12 and a second end operatively attached to the side of the wall 50 by means of a slide 64 for compensation of the circular movement of the arm 62 with reference to the linear movement of the wall 50, which slides along the sides of the bucket 40 as shown in FIGS. 1 and 2. Of course, another type of moving means, such as a directly connected actuators, may be used for obtaining the same result.

The actuators 60 are powered by an hydraulic pump driven by the engine 18. Preferably, a controller and a remote control system (not shown) allow the driver to activate the wall 50 from its loader. The controller controls the sequence of the movement of the wall 50. The controller and the remote control system are parts currently available on the market and can be easily mounted for operating the apparatus 10 by a person skilled in the art. Of course, there may be some other controls on the apparatus 10 itself.

As aforesaid, the screen 22 is set in angle with reference to the ground. It has an edge adjacent the side 16 higher than the opposite edge, which is adjacent the side 14. To obtain an optimum efficiency, the slope of the screen 22 needs to be not too gentle or steep. A too gentle slope reduces the evacuation speed of the coarse materials which will accumulate on the screen 22 and prevent the finer materials from going through its meshes. A too steep slope allows some of the finer materials to go down rapidly towards the lower edge without having a chance to go through the meshes, therefore rejecting them with the coarse materials. It is recommended that a slope of about 10° be used.

Preferably, the bottom of the bucket 40 is parallel to the screen 22. Therefore, the wall 50 is moving slightly upwardly.

In use, the loader shovels up some mixed materials with its bucket and drops its load into the bucket 40. When the unloading is over, the operator presses a button on the remote control device activating the wall movement sequence. The movement of the wall 50 begins and the screen 22 is constantly fed in mixed materials to be sieved. The vibrations allow the screen 22 to work properly and to accelerate the evacuation of the coarse materials accumulating on the lower edge of the screen 22. The evacuation occurs through an opening in the side 14.

The finer materials fall by gravity in an enclosure 13 at the lower portion of the frame 12. The enclosure 13 is enclosed between sides of the frame 12 and is accessible by the open side 16. The open side 16 is large enough to accommodate the bucket of the loader or another evacuation means, such as a conveyor which can be used to directly load a truck. The enclosure 13 allows the finer materials to fall by gravity without being blown away by the wind. The loader then removes the finer materials when they are in sufficient quantity.

Figure 3:
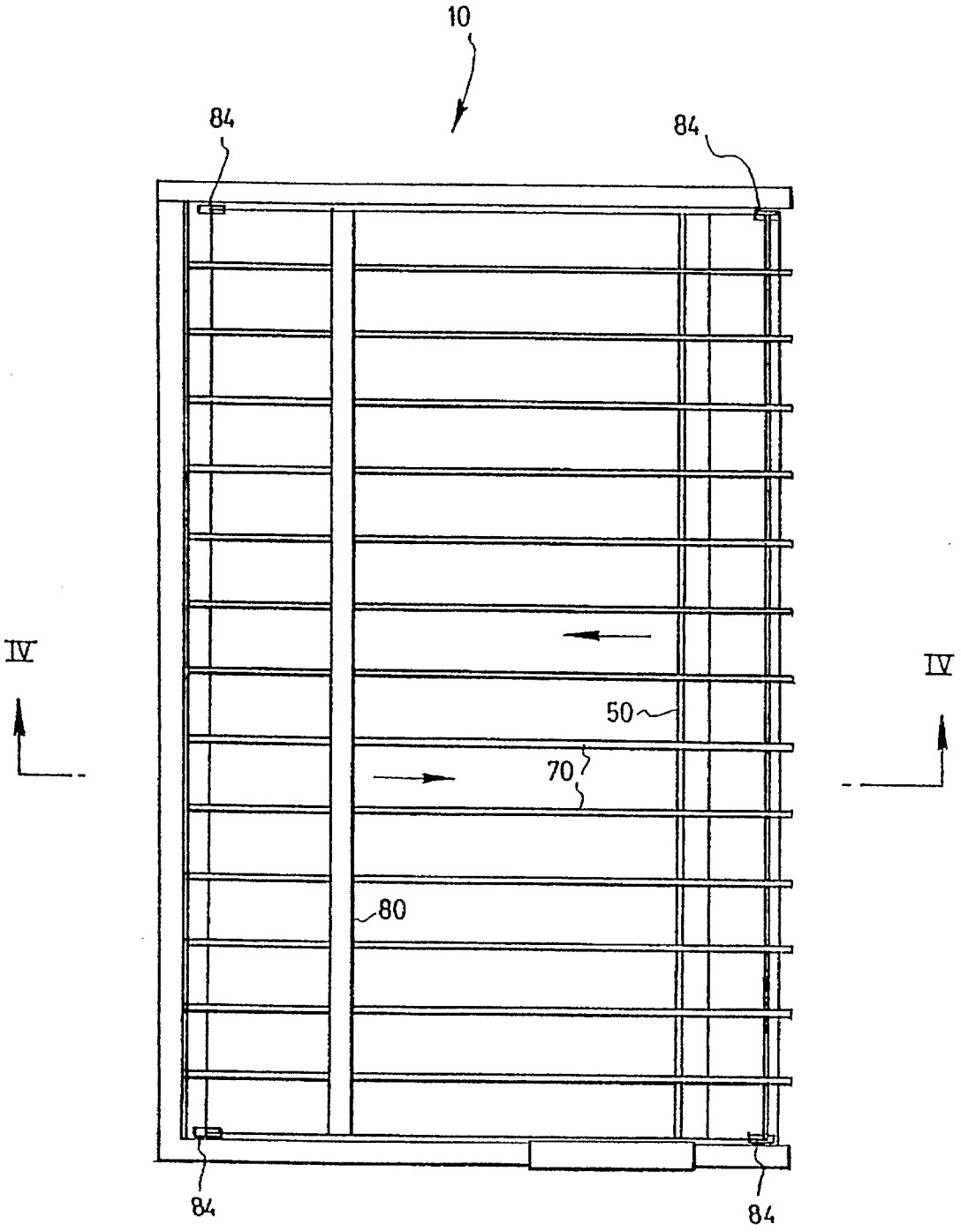
FIG. 3 is a top view of the bucket of the screening apparatus of FIG. 1 without the wheels.

Since some mixed materials may comprise large rocks, decaying roots, stumps or similar debris, the bucket 40 may comprise a superior part provided with screen means for preventing large coarse materials from falling into the bucket 40. Referring to FIG. 3, those screen means may comprise a plurality of spaced bars 70 parallel to each other and parallel to the displacement of the wall 50 and acting as a filter. The bars 70 are parallel to the bucket 40, itself parallel to the sloping screen 22. The slope of the bars 70 allows some debris to fall adjacent the side 14.

The bars 70 have ends inserted in slots 72 provided in the upper section of the frame 12 and some bars 70 can be removed if there is the need for obtaining a greater mesh of the screen means. Typically, the spacing between the bars 70 is 20 cm. The wall 50 has also slots 52 for clearing the bars 70.

Since some of the debris stopped by the bars 70 may not fall by gravity in spite of the slope, there may be provided means for sweeping away the large coarse materials from the bars 70 each time the wall 50 is pushing the mixed materials into the bottom opening 42.

Figure 4:
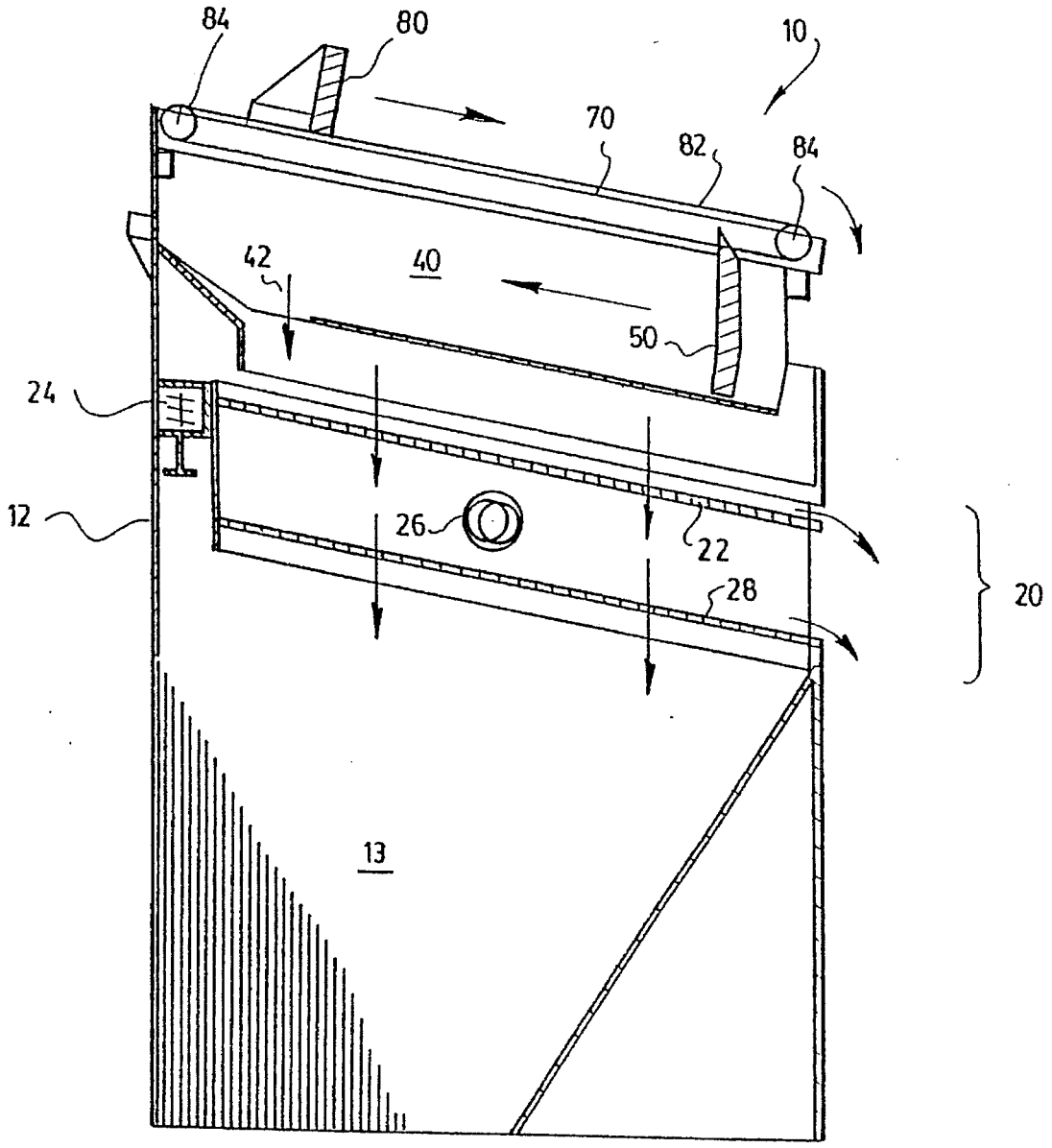
FIG. 4 is a cross-sectional view taken along line IV—IV of FIG. 3.

Referring to FIGS. 3 and 4, the means for sweeping away the large coarse materials may comprise a movable rack 80 operated by a steel cable 82 and pulleys 84 provided for moving the rack 80 along the bars 70 in a direction opposite to a direction of movement of the wall 50. The rack 80 is moving at the same speed than the wall 50 since the rack 80 is mechanically connected to it. When the wall 50 is reset towards its initial position, the rack 80 is also moved towards its initial position, opposite the initial position of the wall 50.

As shown in FIG. 4, the pulleys 84 are located at both sides of the bucket 40 and the upper strand in connected to the rack 80 while the lower strand is connected to the wall 50. Of course, it is possible to reverse the order.

The rack 80 may also prevent the mixed materials from accidentally falling over the upper edge of the bucket 40 adjacent the side 16 and thus contaminating the finer materials accumulating under the apparatus 10. This may happen when the loader unloads its bucket into the bucket 40.

As shown in FIGS. 3 and 4, the rack 80 may also be used to mark the edge of the bottom opening 42, indicating the loader operator to drop the mixed materials not directly over the opening 42. Therefore, instead of having the rack 80 near the upper edge of the bucket 40, at the initial position, the rack 80 may be inside of about the width of the opening 42. This will not have an impact on the movement of the wall 50 because the wall 50 stops over the edge of the opening 42, which is when the rack 80 will be at the side of the bucket 40. Of course, it is possible to change the ratio between the wall 50 and the rack 80 for obtaining a full movement of the wall 50.

Additionally, the wall so may comprise lateral flanges 54 for preventing some mixed materials from falling over the sides of the bucket 40.

Referring again to FIG. 1, to obtain further finer materials, the vibrating screen unit may comprise a second material separating screen 28 underneath the screen 22 and in parallel thereto. The screen 28 has meshes smaller than meshes of screen 22, whereby the finer materials are sieved a second time by the screen 28.

Because the coarse materials may accumulate around the apparatus 10 after a certain amount of time and since some of the coarse materials may be suitable for other applications, there may be provided a transversal longitudinal conveyor 90 adjacent the lower edge of the screen 22 for conveying the coarse materials rejected therefrom to a remote location, as shown in FIGS. 1 and 2. Another conveyor (not shown) may also be used for removing either the larger coarse materials stopped by the bars 70 or the finer coarse materials rejected by the screen 28, if applicable.

The construction of the apparatus 10 is thus very compact and it is likely to be easily transported between excavation sites. The apparatus 10 can be transported on a flat bed truck or by hauling it if it comprises at least one pair of wheels 100 and a trailer hitch 102, allowing a full portability. The wheels 100 may be raised or lowered by means of an hydraulic actuator (not shown). When the apparatus 10 is not hauled or when it is working, the bottom of the frame 12 rests on the ground.

According to another object of the invention, there is provided a method for separating mixed material into coarse materials and finer materials. The method comprises the steps of:

- dumping mixed materials into a bucket located in an upper section of a screening apparatus;
- moving a wall at a predetermined speed along the bottom of the bucket for pushing the mixed materials into a bottom opening located in the bucket over a first material separating screen;
- shaking the first material separating screen.

In the method, the first material separating screen is fed with the mixed materials as the wall pushes the mixed materials at the predetermined speed along the bottom of the bucket into the bottom opening. The apparatus 10 is an example of device in which the above-mentioned method can be carried out.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

We claim:

1. A screening apparatus for separating mixed material into coarse materials and finer materials, said screening apparatus comprising:

a frame having a lower section for resting on a surface, and an upper section;

a vibrating screen unit comprising a first material separating screen sloping downward with respect to said surface from an upper edge toward a lower edge, said first material separating screen being supported by said frame between said lower and upper sections;

shaking means for shaking said vibrating screen unit;

a bucket for receiving the mixed materials, said bucket being located in the upper section of said frame and comprising a bottom opening located over said first material separating screen adjacent the upper edge thereof;

an upright wall movable along the bottom of said bucket for pushing the mixed materials along the bottom of said bucket and into said bottom opening; and means for moving said wall across said bucket at a predetermined speed;

whereby said first material separating screen is fed with the mixed materials as said wall pushes the mixed materials at the predetermined speed along the bottom of said bucket into said bottom opening.

2. A screening apparatus according to claim 1, wherein said bucket has a superior part provided with screen means for preventing large coarse materials from falling into said bucket.

3. A screening apparatus according to claim 2, wherein said screen means comprise a plurality of spaced bars parallel to each other and parallel to the displacement of said wall, said bars having ends inserted in slots provided in the upper section of said frame.

4. A screening apparatus according to claim 3, further comprising means for sweeping away the large coarse materials on an upper surface of said screen means.

5. A screening apparatus according to claim 4, wherein said means for sweeping away the large coarse materials comprise a movable rack operated by a cable and pulley linkage provided for moving said rack along the upper surface of said screen means in a direction opposite to a direction of movement of said wall.

6. A screening apparatus according to claim 1, wherein said means for moving said wall comprise at least two hydraulic actuators, each of said actuators operating an arm having a first end operatively attached to said frame and a second end operatively attached to said wall.

7. A screening apparatus according to claim 1, wherein said vibrating screen unit comprise a second material separating screen underneath said first material separating screen and in parallel thereto, said second material separating screen having meshes smaller than meshes of said first material separating screen, whereby said finer materials are sieved a second time by said second material separating screen for obtaining further finer materials.

8. A screening apparatus according to claim 1, further comprising a transversal longitudinal conveyor adjacent the lower edge of said first material separating screen for conveying said coarse materials rejected therefrom to a remote location.

9. A screening apparatus according to claim 1, further comprising at least one pair of wheels and a trailer hitch so that said screening apparatus is portable.

10. The screening apparatus according to claim 1, wherein the bottom of said bucket is parallel to said first material separating screen, and said upright wall pushes the mixed materials upwardly along the bottom of said bucket through said bottom opening at the upper edge thereof.

11. A screening apparatus for separating mixed material into coarse materials and finer materials, said screening apparatus comprising:

a frame having a lower section for resting on a surface, and an upper section;

a vibrating screen unit comprising a first material separating screen sloping downward with respect to said surface from an upper edge toward a lower edge, and a second material separating screen underneath said first material separating screen and in parallel thereto, said second material separating screen having meshes smaller than meshes of said first material separating screen so that said finer materials are sieved a second time by said second material separating screen for obtaining further finer materials, said first and second material separating screens being supported by said frame between said lower and upper sections;

shaking means for shaking said vibrating screen unit;

a bucket for receiving the mixed materials, said bucket being located in the upper section of said frame and comprising a bottom opening located over said first material separating screen adjacent the upper edge thereof, and having a superior part provided with screen means for preventing large coarse materials from falling into said bucket, said screen means comprising a plurality of spaced bars parallel to each other and parallel to the displacement of said wall, said bars having ends inserted in slots provided in the upper section of said frame;

means for sweeping away the large coarse materials on an upper surface of said screen means, said means for sweeping away the large coarse materials comprising a movable rack operated by a cable and pulley linkage provided for moving said rack along the upper surface of said screen means in a direction opposite to a direction of movement of said wall;

a wall movable along the bottom of said bucket for pushing the mixed materials into said bottom opening;

means for moving said wall at a predetermined speed, said means comprising at least two hydraulic actuators, each of said actuators operating an arm having a first end operatively attached to said frame and a second end operatively attached to said wall;

a transversal longitudinal conveyor adjacent said lower edge of said first material separating screen for conveying said coarse materials rejected therefrom to a remote location; and at least one pair of wheels and a trailer hitch so that said screening apparatus is portable;

whereby said first material separating screen is fed with the mixed materials as said wall pushes the mixed materials at said predetermined speed along the bottom of said bucket into said bottom opening.

12. A method for separating mixed material into coarse materials and finer materials, said method comprising the steps of:

dumping mixed materials into a bucket located in an upper section of a screening apparatus;

moving an upright wall at a predetermined speed along the bottom of said bucket for pushing the mixed materials, along the bottom of said bucket and into a bottom opening located in said bucket over a first material separating screen;

shaking said first material separating screen;

whereby said first material separating screen is fed with the mixed materials as said wall moves across said bucket pushing the mixed materials at the predetermined speed along the bottom of said bucket into the bottom opening.

* * * * *